United States Patent [19]

Balderson

[11] Patent Number: 4,859,835

[45] Date of Patent: Aug. 22, 1989

[54] ELECTRICALLY RESISTIVE TRACKS

[75] Inventor: Simon Balderson, Reading, Great Britain

[73] Assignee: Thorn EMI plc, London, United Kingdom

[21] Appl. No.: 159,675

[22] Filed: Feb. 24, 1988

[30] Foreign Application Priority Data

Feb. 25, 1987 [GB] United Kingdom ..... 8704467

[51] Int. Cl.[4] ..... H05B 3/16

[52] U.S. Cl. ..... 219/543; 29/612; 219/552; 219/553; 338/25; 338/308

[58] Field of Search ..... 219/543, 552, 553; 338/24, 25, 138, 308, 309, 320; 29/610.1, 611, 612

[56] References Cited

U.S. PATENT DOCUMENTS

| | | | |
|---|---|---|---|
| 3,304,199 | 2/1967 | Faber, Jr. et al. | 338/308 X |
| 3,349,722 | 10/1967 | Davis | 338/308 X |
| 3,386,165 | 6/1968 | Bruhl, Jr. et al. | 338/308 X |
| 3,503,030 | 3/1970 | Matsumoto et al. | 338/24 X |
| 3,647,532 | 3/1972 | Friedman et al. | 252/512 X |
| 4,237,442 | 12/1980 | Carter | 338/138 X |
| 4,286,377 | 9/1981 | Hurko et al. | 338/25 X |

FOREIGN PATENT DOCUMENTS

| | | |
|---|---|---|
| 990023 | 4/1965 | United Kingdom . |
| 1463317 | 2/1977 | United Kingdom . |

*Primary Examiner*—C. L. Albritton

*Attorney, Agent, or Firm*—Fleit, Jacobson, Cohn, Price, Holman & Stern

[57] ABSTRACT

A heating element comprises an electrically resistive track intended to be formed on an electrically insulative substrate. A heating unit comprises a heating element and a temperature sensor on a substrate, the sensor comprising an electrically resistive track. The track consists of a thick film having in the temperature range of from 0° C. to 550° C. a temperature coefficient of resistance in excess of 0.006 per degree C. The thick film includes a metal and a glass in such proportions as to provide a suitable resistivity and a thermal expansion coefficient to match that of an electrically insulative substrate to which the track is to be applied and to permit adhesion of the track to the substrate.

The considerable variation of the resistance of the track with temperature provides advantages in both of the aforementioned applications.

19 Claims, 3 Drawing Sheets

ELECTRICALLY RESISTIVE TRACKS

This invention relates to heating elements comprising electrically resistive tracks intended to be formed on electrically insulative substrates, and it also relates to temperature sensors comprising such tracks.

In co-pending British Patent Application No. 8704468 there is described a substrate suitable for supporting such resistive tracks, and tracks in accordance with this invention are especially, though not exclusively, suitable for deposition upon substrates of the kind described in the aforementioned patent application.

Currently used heating devices including electric cooker hobs contain a heating element which, for a given setting, dissipates a constant power. The heat-up rate of the element from ambient temperature to its normal operating temperature is accordingly limited by the constant power output at the maximum setting.

The inventor has realised that for such applications, there is an advantage in providing a heating element whose power dissipation varies with temperature.

According to a first aspect of the present invention, there is provided a heating element comprising an electrically resistive track, said track consisting of a thick film having in the temperature range of from 0° C. to 550° C. a temperature coefficient of resistance in excess of 0.006 per degree C, said thick film including a metal and a glass in such proportions as to provide a suitable resistivity and a thermal expansion coefficient to match that of an electrically insulative substrate to which said track is to be applied and to permit adhesion of said track to a said substrate.

The extremely high temperature co-efficient of resistance of the heating element permits the track to have a low resistance at ambient temperatures, hence allowing, on energisation of the track, a high initial current to be drawn, thus achieving rapid initial heating. This heating causes the resistance of the track to rise sharply, thus reducing the current as the normal operating temperature of the track is reached. Thus rapid heat-up and effective self-regulation are achieved.

Self-regulation also is achieved in the circumstance that the heating element has been pre-set to dissipate a given power and a pan of cold water (say) is placed directly over it (probably on top of a glass ceramic layer beneath which the heating element is mounted). The pan will act as a heat sink, reducing the temperature of the element, thus causing it to draw more current and increasing the power dissipated by the element, and thus heat rapidly the contents of the pan.

According to a second aspect of the present invention, there is provided a heating unit comprising an electrically insulative substrate, a heating element and a temperature sensor applied to said substrate; said sensor including an electrically resistive track, said track consisting of a thick film having in the temperature range of from 0° C. to 550° C. a temperature coefficient of resistance in excess of 0.006 per degree C, said thick film including a metal and a glass in such proportions as to provide a suitable resistivity and a thermal expansion coefficient to match that of said substrate and to permit adhesion of said track to said substrate.

The considerable variation in resistance of the sensor track with temperature is used to monitor the temperature of a substrate. The printed format of the sensor track allows direct temperature monitoring of the surface of the substrate and avoids the problem of hysteresis associated with known temperature sensors, such as bimetal strips, which, because of their configuration, must necessarily be distant from the surface of the substrate.

Particularly useful materials for the track are nickel, iron and cobalt. It is also envisaged that alloys of these metals may be used, provided that the second phase of the alloy is insufficient to substantially reduce the temperature coefficient of resistance of the alloy from that of the bulk metal.

In order that the invention may be clearly understood and readily carried into effect, some embodiments thereof will now be described, by way of example only, and with reference to the accompanying drawings in which.

In a preferred embodiment of the first aspect of the invention, a thick film for a heating element has a composition by weight of 80% metal powder and 20% glass powder. Thick films having a composition by weight in the range of from 50% metal/50% glass to 95% metal/5% glass may also be used for the heating element. In one preferred embodiment of the second aspect of the invention, a thick film for a temperature sensor on a heating unit has a composition by weight of 80% metal powder and 20% glass powder while in a second embodiment the composition by weight of the thick film is 50% metal powder to 50% glass powder. The sensor track may also be made from a thick film having a composition by weight in the range of from 50% metal/50% glass to 95% metal/5% glass.

A typical, but non-limiting, glass powder used has the percentage composition by weight as below:

$SiO_2$: 73.39
$Al_2O_3$: 6.43
CaO: 1.29
$K_2O$: 0.32
$Na_2O$: 6.29
BaO: 2.71
$B_2O_3$: 9.57

Figure 1:
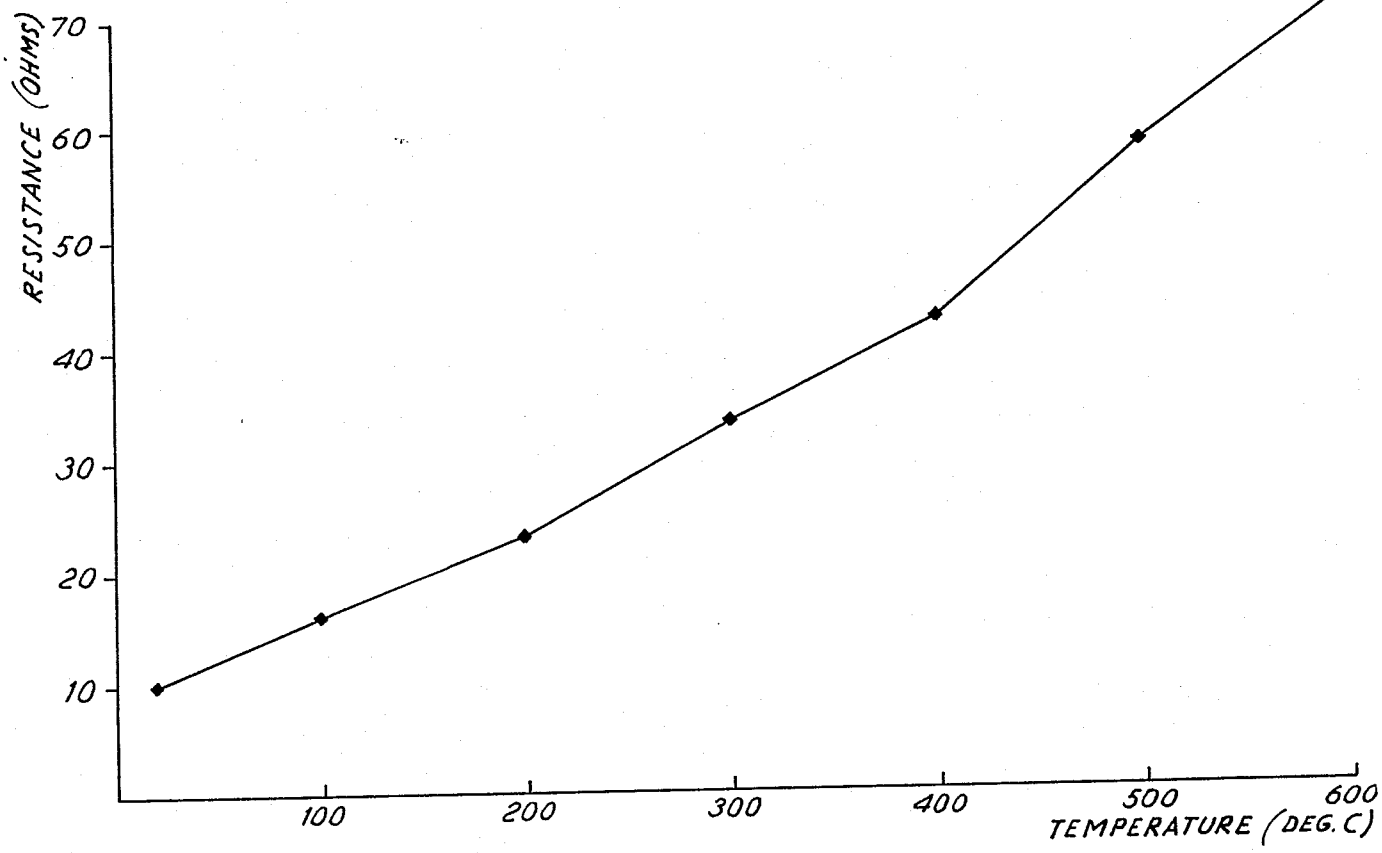
FIG. 1 is a graph showing approximate variation in resistance with temperature for a thick film track for a heating element or as a temperature sensor for a heating unit in accordance with the invention.

FIG. 1 shows the approximate variation in resistance with temperature for a nickel thick film track having the composition by weight of 80% nickel and 20% glass. The glass used was of the aforementioned composition. As can be seen, the variation in resistance with temperature is considerable.

In general, the glass for the thick film track has a melting point of about 800° C. This enables the ink from which the track is to be made to be fired at a high temperature to ensure effective sintering of the metal without the glass bleeding out. The high melting point of the glass also provides high temperature stability. The composition of the glass is chosen so that the thermal expansion coefficient of the thick film is compatible with that of a substrate to which the track is to be applied.

The proportion of metal to glass in the thick film used affects, inter alia, the following properties:

(a) The resistivity/conductivity of the thick film. This affects the possible power dissipation of heater tracks made of the thick film and the electrical circuitry required for the temperature sensor.

(b) The thermal expansion coefficient of the thick film. This should be compatible with that of a substrate to which the thick film is to be applied.

(c) The adhesion of the thick film to a substrate to which the thick film is to be applied—if the proportion of metal is too high, the thick film will not adhere to the substrate.

One method of manufacturing an electrically resistive thick film track suitable for a heating element or a temperature sensor on a substrate is described hereinafter.

Nickel and glass powders of average particle size 5 μm are mixed in the required ratio with a screen printing medium, such as ESL400, in a sufficient quantity to form a thick liquid slurry with a viscosity that allows the slurry to be easily screen printed. The mixture is then passed through a triple roll mill to ensure adequate wetting of the nickel and glass powders by the screen printing medium, forming an ink. The resulting ink is screen printed in the desired pattern onto the substrate, dried at 150° C. and fired at a temperature in the range of from 750° C. to 1100° C. The firing procedure is preferably carried out in a nitrogen atmosphere to prevent oxidation of the metal.

Figure 2:
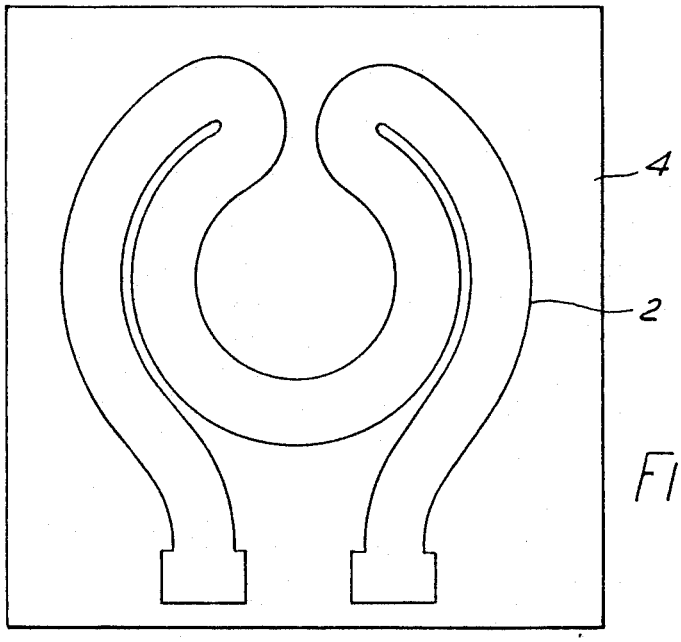
FIG. 2 shows, in plan view, a heating element in accordance with the invention on a substrate.

A suitable pattern for the track is as shown in FIG. 2 which shows a heating element 2 on a substrate 4, suitable for use as a hob unit. The heating element 2 is connected to a power supply by electrical connectors (not shown).

With respect particularly to nickel, it has been found that, when applied to a substrate comprising a metallic support plate coated with glass ceramic material, a thick film track in accordance with this invention exhibits an ability to resist perforation even if a pore in the glass ceramic coating of the substrate and closely proximate to the track should rupture, for example as a result of the electric field established between the track, which generally is run at mains voltage, and the metallic support plate, which is generally earthed, or as a result of the heat generated where the track is used as a heavy duty heating element, for a cooker hob for example.

As suggested hereinbefore, thick film tracks provided in accordance with this invention may advantageously be deposited upon substrates of the kind described in our copending European Patent application which claims priority from GB 8704468. This patent application describes and claims a substrate for supporting electrical components, said substrate comprising a plate member having on at least one surface a layer of a glass ceramic material wherein the percentage porosity of the glass ceramic layer, as defined hereinafter, is equal to or less than 2.5.

By percentage porosity is meant the porosity at a random cross-sectional plane through the substrate perpendicular to the plate member expressed as the percentage ratio of the cross-sectional area of pores on the plane to the cross-sectional area of the remainder of the glass ceramic layer on that plane.

The use of a heating element in accordance with the invention lends itself to use in conjunction with an energy management system, especially where two or more units are incorporated in a hob-top or cooker, thus permitting avoidance of the possibility that two or more elements could attempt to draw surge currents simultaneously. In conjunction with an energy management system or independently, the considerable variation in resistance of the track with temperature renders it possible to use the track or tracks included in a given system as part of a bridge circuit, for example, to monitor the current temperature of the or each track.

Figure 3:
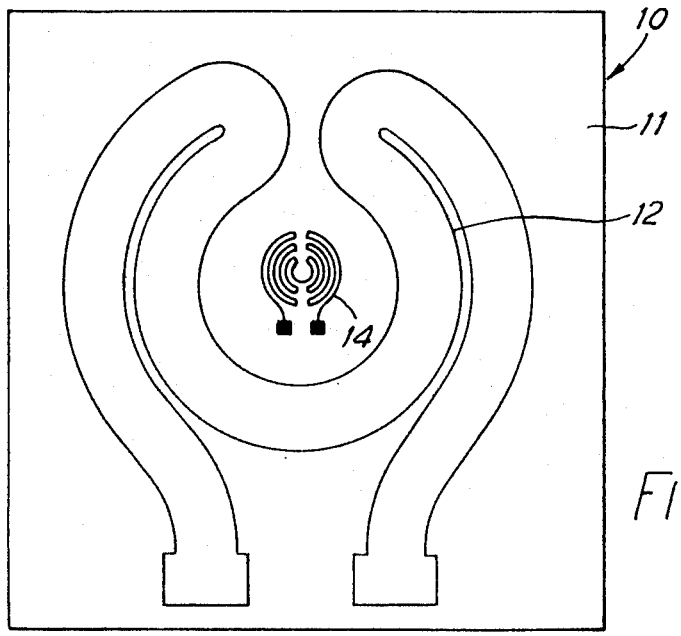
FIG. 3 shows, in plan view, a heating unit comprising a heating element with a sensor track applied to a substrate.

FIG. 3 shows (external connections not shown) a heating unit 10 comprising a substrate 11 bearing a heating element 12 and a temperature sensor 14, the temperature sensor being a thick film track having a high temperature coefficient of resistance as mentioned hereinbefore. Where the heating element comprises a thick film track (for example, a heating element in accordance with said first aspect of the present invention), the heating track and sensor track may be manufactured in the same process.

To spot local hot spots, a sensor track could be arranged to closely follow the path of an associated heater track so as to cover a large area of the substrate. An area to be heated could be monitored by several sensors in the area acting as one pan-size sensor.

It is particularly necessary to provide a temperature sensor on glass ceramic substrates having a metallic support plate as electrical breakdown may occur in the glass ceramic layer when the temperature exceeds 550° C. The sensor track may also be used to regulate the temperature of the substrate and heating track using a suitable electrical circuit to compare the resistance of the sensor track with that of a variable resistor whose resistance is set to correspond to that of the required temperature.

Figure 4:
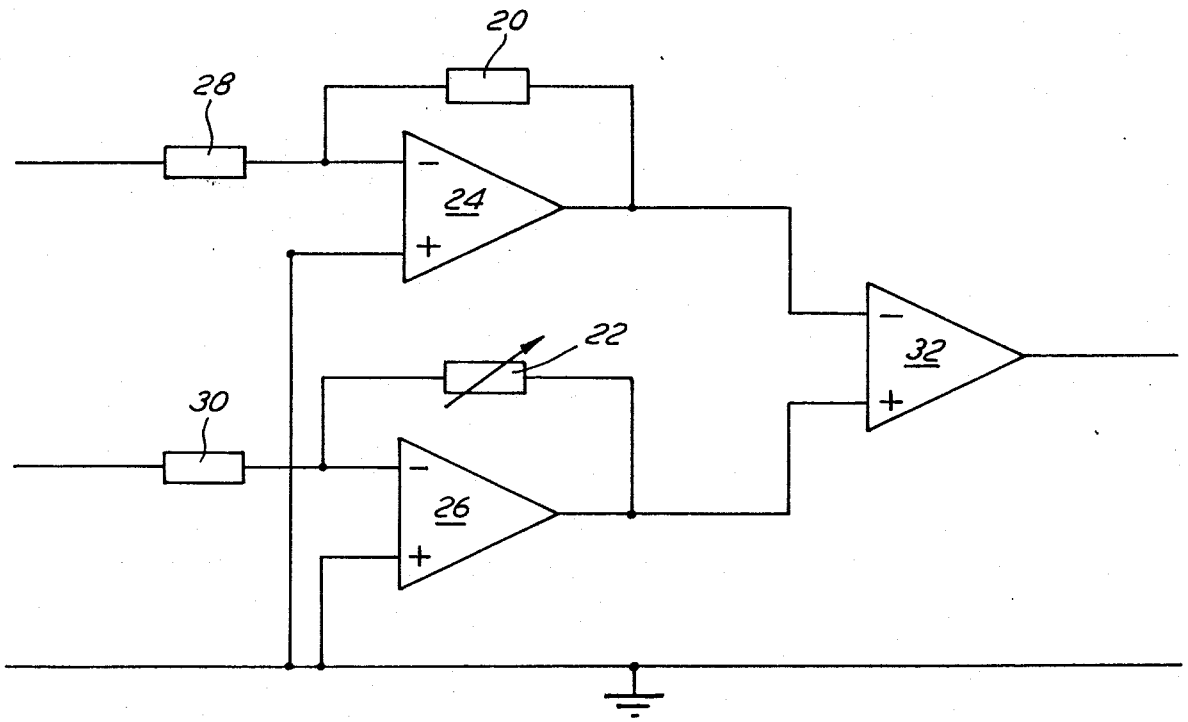
FIG. 4 shows an electrical circuit suitable for use with the sensor track of FIG. 3.

An example of an electrical circuit suitable for use with the sensor track is shown in FIG. 4, where the resistance 20 is the resistance of the sensor track 14 and the variable resistor 22 is pre-set to a resistance corresponding to the required temperature. Operational amplifiers 24, 26, to whose inverting inputs a constant voltage is applied via resistances 28, 30 having the same value, convert the resistances of the sensor track and the variable resistor to voltages which are then compared by a third operational amplifier 32 acting as a comparator. The output of the comparator 32 switches polarity when the resistances of the sensor track and the variable resistor are the same, and accordingly when the sensor track and substrate are at the required temperature, and so can be used to switch the power supply to the heating element on the substrate when the required temperature has been reached.

After the electrically resistive tracks have been applied to the substrate, external connections are added. A suitable electrical connector for making a connection to a thick film track has a cross-sectional area suitable for the required current carrying capacity and comprises a plurality of conductive fibres braided together, each of the fibres having a diameter, preferably in the range of from 30 μm to 300 μm, so as to provide sufficient stiffness to the connector and to permit adhesion of the connector to the thick film track. The connector may be made of various metals, the most suitable metal for a particular application depending in part on the material of the thick film track to which the connector is to be adhered. Suitable metals include stainless steel, nickel and copper. The connector is adhered to the track using a glass/metal adhesive, advantageously the same conductive ink as used to form the thick film track.

The whole is then overglazed using a protecting glass or glass ceramic overglaze to protect the thick film tracks and allow high temperature stable operation.

I claim:

1. A heating unit comprising an electrically insulative substrate and a heating element applied to said substrate, the heating element comprising an electrically resistive track, said track consisting of a thick film having in the temperature range of from 0° C. to 550° C. a temperature coefficient of resistance in excess of 0.006 per degree C, said thick film including a metal and a glass in such proportions as to provide a suitable resistivity and a thermal expansion coefficient to match that of said substrate and to permit adhesion of said track to said substrate.

2. A heating unit according to claim 1 wherein said substrate comprises a plate member having on at least one surface a layer of a glass ceramic material, the glass ceramic layer having a percentage porosity no greater than 2.5, the percentage porosity being defined as the porosity at a random cross-sectional plane through the substrate perpendicular to the plate member expressed as the percentage ratio of the cross-sectional area of the pores on the plane to the cross-sectional area of the remainder of the glass ceramic layer on that plane.

3. A heating unit according to claim 2 wherein said metal comprises one of the group consisting of transition metals and alloys based on a transition metal.

4. A heating unit comprising an electrically insulative substrate, a heating element and a temperature sensor applied to said substrate; said sensor including an electrically resistive track, said track consisting of a thick film having in the temperature range of from 0° C. to 500° C. a temperature coefficient of resistance in excess of 0.006 per degree C, said thick film including a metal and a glass in such proportions as to provide a suitable resistivity and a thermal expansion coefficient to match that of said substrate and to permit adhesion of said track to said substrate.

5. A heating unit according to claim 4 wherein said metal comprises one of the group consisting of transition metals and alloys based on a transition metal.

6. A heating unit according to claim 4 wherein said heating element comprises an electrically resistive track, said track consisting of a thick film having in the temperature range of from 0° C. to 500° C. a temperature coefficient of resistance in excess of 0.006 per degree C, said thick film including a metal and a glass in such proportions as to provide a suitable resistivity and a thermal expansion coefficient to match that of said substrate and to permit adhesion of said track to said substrate.

7. A heating unit according to claim 4 wherein said substrate comprises a plate member having on at least one surface a layer of a glass ceramic material, the glass ceramic layer having a percentage porosity no greater than 2.5, the percentage porosity being defined as the porosity at a random cross-sectional plane through the substrate perpendicular to the plate member expressed as the percentage ratio of the cross-sectional area of the pores on the plane to the cross-sectional area of the remainder of the glass ceramic layer on that plane.

8. A heating unit according to claim 1 wherein the proportion by weight of metal and glass in the thick film is in the range of from 50% metal/50% glass to 95% metal/5% glass.

9. A heating unit according to claim 8 wherein said metal comprises one of the group consisting of transition metals and alloys based on a transition metal.

10. A heating unit according to claim 6 wherein said metal comprises one of the group consisting of transition metals and alloys based on a transition metal.

11. A heating unit according to claim 7 wherein said metal comprises one of the group consisting of transition metals and alloys based on a transition metal.

12. A heating unit according to claim 1 wherein said metal comprises one of the group consisting of transition metals and alloys based on a transition metal.

13. A heating unit according to claim 12, 3, 9, 5, 10 or 22 wherein said transition metal is nickel.

14. A heating unit according to claim 12 wherein said transition metal is one of the group consisting of colbalt and iron.

15. A heating unit according to claim 6 wherein said substrate comprises a plate member having on at least one surface a layer of a glass ceramic maerial, the glass ceramic layer having a percentage porosity not greater than 2.5, the percentage porosity being defined as the porosity at a random cross-sectional plane through the substrate perpendicular to the plate member expressed as the percentage ratio of the cross-sectional area of the pores on the plane to the cross-sectional area of the remainder of the glass ceramic layer on that plane.

16. A heating unit according to claim 2 wherein the proportion by weight of metal and glass in the thick film is in the range of from 50% metal/50% glass to 95% metal/5% glass.

17. A heating unit according to claim 4 wherein the proportion by weight of metal and glass in the thick film is in the range of from 50% metal/50% glass to 95% metal/5% glass.

18. A heating unit according to claim 6 wherein the proportion by weight of metal and glass in the thick film is in the range of from 50% metal/50% glass to 95% metal/5% glass.

19. A heating unit according to claim 7 wherein the proportion by weight of metal and glass in the thick film is in the range of from 50% metal/50% glass to 95% metal/5% glass.

* * * * *